US006220559B1

(12) United States Patent
Chow

(10) Patent No.: US 6,220,559 B1
(45) Date of Patent: Apr. 24, 2001

(54) READING ASSISTIVE DEVICE FOR INDIVIDUALS

(76) Inventor: Steven Chow, 12 Hill Farm Cir., North Oaks, MN (US) 55127

( * ) Notice: Subject to any disclaimer, the term of this patent is extended or adjusted under 35 U.S.C. 154(b) by 0 days.

(21) Appl. No.: 09/323,876

(22) Filed: Jun. 1, 1999

(51) Int. Cl.[7] ..... A47B 23/00
(52) U.S. Cl. ..... 248/445; 248/450; 248/451
(58) Field of Search ..... 248/445, 446, 248/447, 448, 449, 450, 451, 444.1, 447.2, 460

(56) References Cited

U.S. PATENT DOCUMENTS 2,448,734 * 9/1948 Phillips ..... 248/445
2,780,027 * 2/1957 Laing ..... 248/445
2,828,577 * 4/1958 Anderson ..... 248/445
3,408,032 * 10/1968 Francis ..... 248/450
4,496,126 * 1/1985 Melton et al. ..... 248/447.2
4,771,977 * 9/1988 Larson ..... 248/460
5,088,677 * 2/1992 Chandler et al. ..... 248/451
5,913,502 * 6/1999 Smith ..... 248/445

* cited by examiner

*Primary Examiner*—Anita M. King
*Assistant Examiner*—N. Morrison
(74) *Attorney, Agent, or Firm*—Gregory F. Cotterell

(57) ABSTRACT

A reading assistive device 10 that suspends reading material above a reclining or supine user. Reading assistive device 10 communicates with the reading material using wing folds 20, 22 of page support 12. The reading material is fit through a central window 18 of page support 12 and the pages rest upon left wing fold 20 and right wing fold 22. Wing folds 20, 22 have slots 24, 26 that enable a the user directly, or with the mouthstick, to interact with the reading material pages. The reading material is secured between a rigid rod 42 and an elastic cord 68 that comprises part of a securing subassembly 40. An interlocking endcap 58 and an interlocking endcap 44 enable securing subassembly 40 to operably interact with page support 12. Page support 12 is supported by an articulated swing arm subassembly 38, which enables reading assistive device 10 to suspend reading material above a reclining or supine user from their bed or chair.

13 Claims, 4 Drawing Sheets

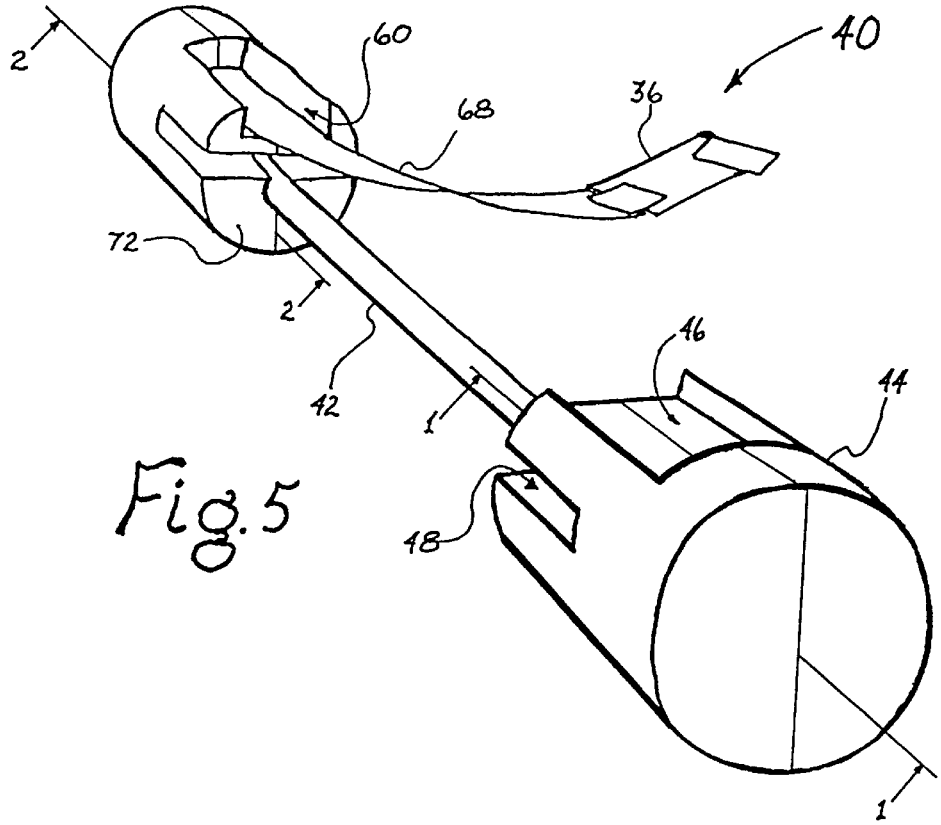
Fig. 5
Fig. 6a
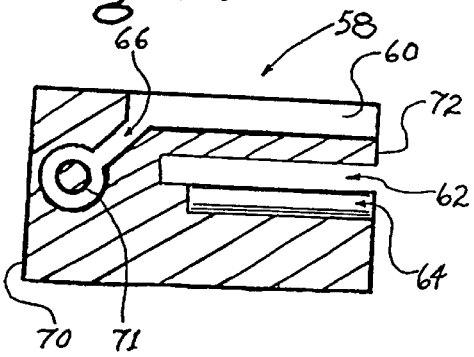
Fig. 6b
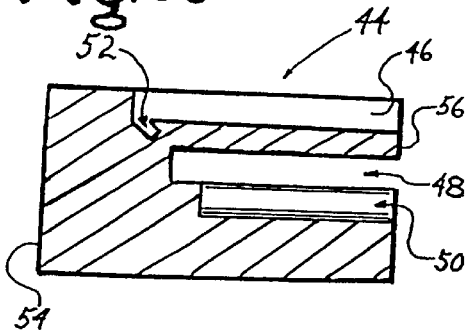

READING ASSISTIVE DEVICE FOR INDIVIDUALS

FIELD OF INVENTION

This invention relates to a device that holds reading materials, such as magazines, books and journals above a reclining or supine user. More specifically, the invention allows the previously described reading materials to be suspended above a user who has minimal arm function, enabling the disabled individual to effectively communicate with the reading material pages using a device such as a mouthstick.

BACKGROUND OF THE INVENTION

Many people, through disease or injury, may become bed ridden for greater or lesser periods of time. While confined to bed, the person's options for keeping occupied are severely limited. Many people so confined prefer to read as one means for passing the time during their convalescence. However, holding a book up above while laying on one's back for any length of time is tedious and exhausting. In fact, there is a significant subset of individuals who have suffered such debilitating injuries that they have lost use of their upper extremities and no longer have the ability to hold up a book, magazine, and the like.

Devices exist that enable reclining or supine individuals to read with minimal manual interaction. One example, U.S. Pat. No. 5,351,927, issued to Howell, is a book holder that sandwiches the reading material between a clear acrylic sheet and a solid backing. For this design, the reading material rests on a transparent flat plane and the pages are read through the clear material. While this type of invention permits the reclining user the ability to read without holding the book, page turning is difficult. The user must first loosen the transparent plate, reach behind the acrylic, turn the page, and then return the acrylic to its original position.

Other book holder designs sacrifice visibility for easier page interaction. These types of inventions use vertical or horizontal straps that run across a page and secure the book. U.S. Pat. No. 5,690,309, issued to Blum, illustrates a book that communicates with a solid panel by straps that vertically traverse the pages being read. With this type of device, the user loosens the straps and then turns the page.

Although the previously mentioned products allow an individual to read in a nonsitting position, page turning is cumbersome. More importantly, the various devices do not address the needs of disabled individuals with limited arm motion and strength. For individuals using a sandwiched book device, page turning is difficult, as the individual's arm must first manipulate a plate to turn a page. Inventions using elastic straps also provide a great challenge to individuals with limited arm function. If not properly released, the strap could tear the turning page. Additionally, the tucking of a page is extremely difficult. If the elastic straps run vertically across the page, for instance, the entire edge of the fibrous paper must always be parallel to the cord, otherwise the paper will crease and tear when it maneuvers past a strap. Additionally, individuals with limited arm motion and strength have difficulty interacting with devices that require strap manipulation.

There is, however, a design that permits reclining patients with limited arm motion to read and interact with books and magazines. U.S. Pat. No. 4,294,425, issued to Weber, provides an example of a device created for individuals who interact with other objects using a mouthstick. In this example, the reading material is fastened to a solid panel with an elastic strap wrapped along the binding of the read item. Clips attached to the panel secure the pages of the reading material. To turn a page, the rubber tip of the user's mouthstick presses against the paper, and the friction between the mouthstick and the page slides the paper out of the clip. Unfortunately, this device is clumsy in actual use, as the pages are difficult and troublesome to secure after the page is turned. For the device that clips the corners of the paper, only one page corner can be secured at a time, which is difficult with a single mouthstick. Additionally, the paper is easily torn when it is underneath the clip. Another problem is that as the pages accumulate, there is an increasing chance that the additional weight will cause the pages to be released by the clip. Even if tightly binding clips are used, they are very difficult to pry open using mouthstick-like devices. Regardless of the clip type, any type of paper interaction with a clip often results in the paper being creased or even torn.

What is needed is a device that provides for a user, even one of limited strength or agility, to secure reading material in a viewable position that will not have a tendency to bend or tear the pages. Such a device would be useful while the user is in a reclined or recumbent position.

SUMMARY OF THE INVENTION

The present invention comprises a reading assistive device for use by person in a recumbent or reclined position to suspend a reading material above the person in a readable position. The reading assistive device comprises a page support and a securing subassembly. The page support includes a base plate with an upper surface, a lower surface facing toward the person, a front edge, a back edge, a central window, and lateral wing folds that bend back toward the lower surface of the base plate, each wing fold having a slot oriented in a direction parallel to the front and back edges and forming a plane surface that is tilted toward the lower surface and forms an acute angle with the plane of the lower surface medially.

The securing subassembly comprises a first endcap, a second endcap and a rigid rod connecting the first and second endcaps, the first and second endcaps being operably coupled to the base plate toward respective front edge and back edge, bisecting the base plate at its midpoint with the rigid rod oriented perpendicular to the front and back edges, the first endcap having an elastic cord affixed to the first endcap, the elastic cord having a clip at its free end, the clip being operably and releasably attachable to the second endcap.

The page support and securing subassembly interact so that the reading material may be draped over the rigid rod through the central window with the elastic cord securing the reading material to the rigid rod by clipping the clip to the second endcap and then placing opposing pages of the reading material in the spaces between the respective wing folds and the lower surface of the base plate, exposing the reading pages, in sequence, through the slots of the respective wing folds.

Accordingly, the present invention permits a supine individual, and specifically, those handicapped with minimal arm function, to read a magazine or other material overhead. The wing fold and slot design of the reading assistive device provide the user maximum control over the page securing and interacting process. An advantage of this design is that the location where the page inserts into the wing fold is the same region where the mouthstick communicates with the paper. Additionally, the clear page support permits clear visibility of the reading material while it is suspended by the page support of the reading assistive device.

While the set-up of a reading assistive device requires the help of another individual, the design of the present invention permits the user independent communication with the reading material. Additionally, the variable positioning of a reading assistive device provides the invention to accommodate the different reclining positions of a user. This invention is also inexpensive and portable, as there are a minimum number of parts, and the parts themselves can be hand carried.

Several objects and advantages of the present invention are to provide an easy method that allows mouthstick-using individuals to easily secure a turned page. To provide a reading device that enables individuals to read while reclined or supine. To provide a minimally interfering method for the binding and supporting of the reading material.

Further objects and advantages are to provide a device that will not damage the reading material and is inexpensive to manufacture. The above and other objects and advantages of the present invention become more readily apparent when reference is made to the following detailed description taken in conjunction with the accompanying drawings. The following descriptions are in no way intended to limit the scope of the present invention.

BRIEF DESCRIPTION OF THE DRAWINGS

FIG. 5 is an enlarged front perspective view of the securing subassembly of the present invention depicted in FIG. 1;

FIG. 6*a* is a cross-sectional view of an interlocking endcap for securing an elastic cord of the securing subassembly taken along the line 2—2 in FIG. 5; and FIG. 6*b* is a cross-sectional view of an interlocking endcap for receiving a clip of the elastic cord taken along the line 1—1 in FIG. 5.

DETAILED DESCRIPTION OF THE INVENTION

Figure 1:
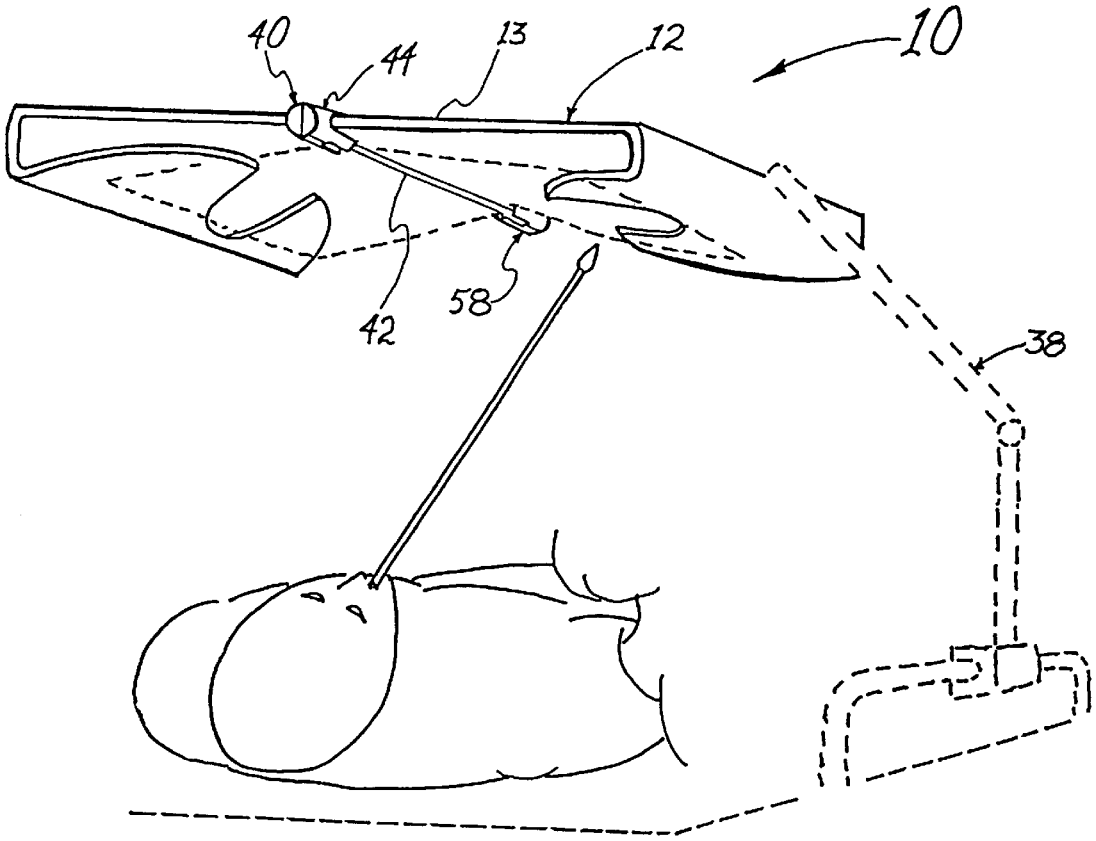
FIG. 1 is a front perspective view of an embodiment of the present invention shown attached to a patient's bed rail with an extendable articulated arm shown in phantom.
Figure 2:
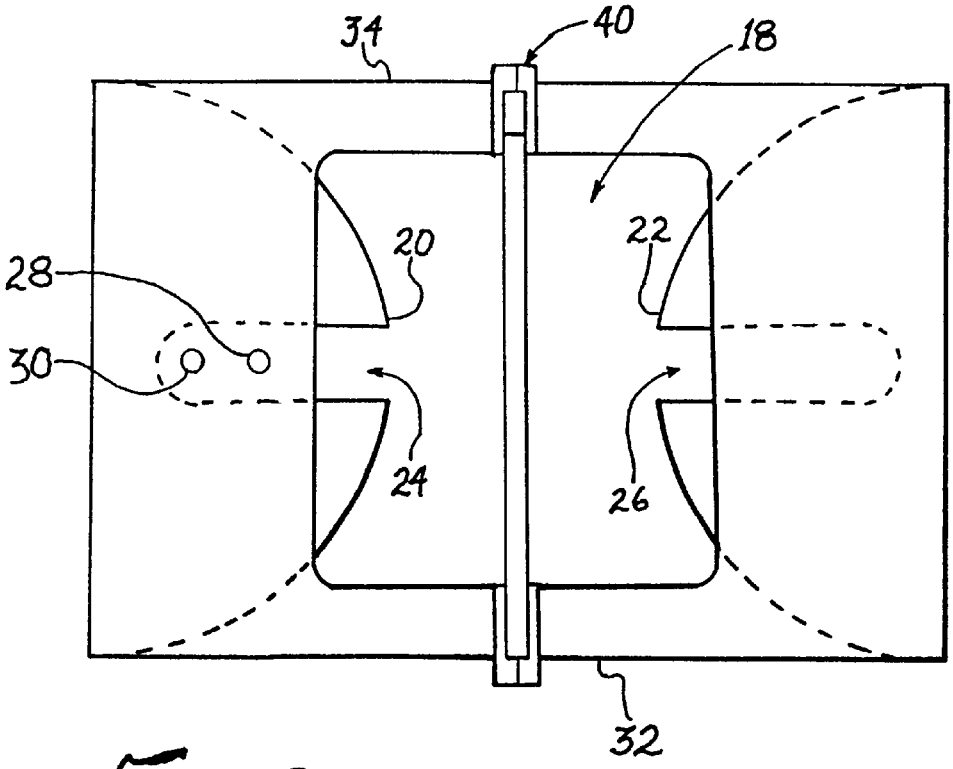
FIG. 2 is a top view of the present invention depicted in FIG. 1.
Figure 3:
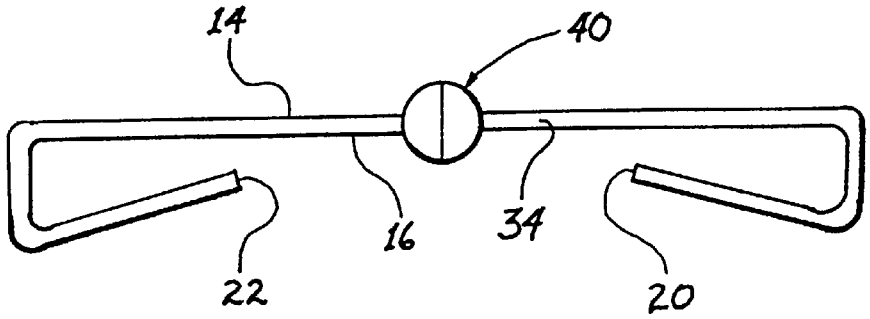
FIG. 3 is a front view of the present invention depicted in FIG. 1.
Figure 4:
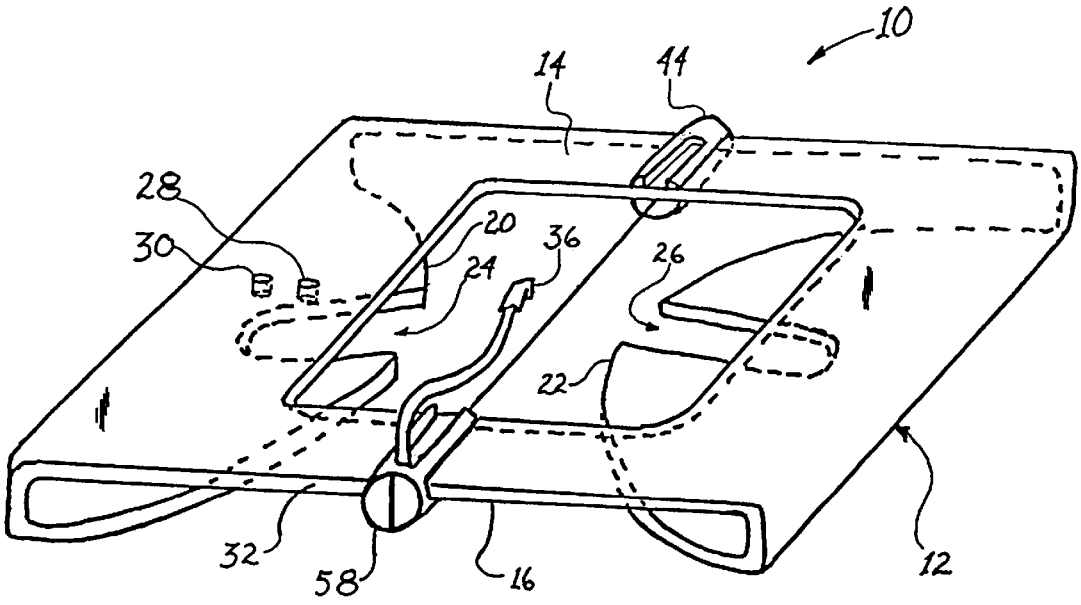
FIG. 4 is a top perspective view of the present invention depicted in FIG. 1 with an elastic cord of the present invention in a released position.

Referring to FIGS. 1 through 6*b*, wherein like numbers depict like components through out the various Figures, there is depicted a reading assistive device 10 comprising a reading material's page support 12 and a reading material's securing subassembly 40. Page support 12 comprises a base plate 13, a left wing fold 20, a right wing fold 22, a front edge 34, and a back edge 32. Left and right wing folds 20, 22 include slots 24 and 26, respectively. Base plate 13 comprises an upper surface 14, a lower surface 16 and a central window 18.

Left and right wing folds 20,22 extend laterally from page support 12 from front edge 34 to back edge 32, folding back on base plate 13 toward lower surface 16, and are at roughly equal distances from securing subassembly 40. Both folds 20, 22 are folded back on base plate 13 toward lower surface 16 such that each fold 20, 22 forms a plane that is tilted toward lower surface 16 and forms an acute angle of intersection with lower surface 16 medially. Left wing fold 20 and right wing fold 22 are angled so that the reading material pages rest flush on the respective surfaces of the left and right wing folds 20, 22.

Securing subassembly 40 comprises an interlocking endcap 44 for a clip 36, interlocking endcap 44 connected by a rigid rod 42 to an interlocking endcap 58 by an elastic cord 68, elastic cord 68 secured to endcap 58 and operably releasably attachable at its other end to endcap 44 using clip 36.

The orientation of securing subassembly 40 lies in the plane of page support 12, extending from front edge 34 to back edge 32, and generally is perpendicular to both front end 34 and back end 32. Securing subassembly 40 traverses central window 18, bisecting base plate 13. For mounting purposes, interlocking endcap 44 and interlocking endcap 58 fit into notches (not depicted) cut into front end 34 and back end 32, respectively, of page support 12.

Turning to FIGS. 5, 6*a* and 6*b*, there is depicted securing subassembly 40 of the present invention. Rigid rod 42 preferably press fits into holes 50, 64 that are in the interface surfaces 56, 72. A slot 62 is cut parallel to the longitudinal axis of interlocking endcap 58 near the center of interface surface 72. Hole 64 is bored adjacent to the surface of slot 62 so that rigid rod 42 is flush with lower surface 16 of page support 12 when reading assistive device 10 is assembled. An elastic cord groove 60 is cut longitudinally along the side of interlocking endcap 58. Located at the inner comer of elastic cord groove 60, and closest to an outer surface 70 of interlocking endcap 58, is a cord slot 66. The looped end of elastic cord 68 slips through and attaches to a fixture 71 within interlocking endcap 58.

For interlocking endcap 44, a slot 48 is cut parallel to the longitudinal axis of interlocking endcap 44 and through an interface surface 56. A hole 50 is bored adjacent to the surface of slot 48, so that page support 12 and rigid rod 42 are flush at lower surface 16 when reading assistive device 10 is assembled. A clip groove 46 is cut longitudinally along the side of interlocking endcap 44. Located at the inner comer of clip groove 46, and closest to an outer surface 54, is a clip securing groove 52. Clip securing groove 52 enables clip 36 to releasably attach to interlocking endcap 44 while lying parallel to the longitudinal axis of interlocking endcap 44.

The present invention anticipates that page support 12 is rigid and transparent. Preferably, page support 12 is of uniform cross section and is constructed from suitable materials such as, but not limited to, acrylic, methacrylic or polycarbonate. Transparent materials allow the user to see through the material and read the item of interest. There are a large number of transparent polymers and copolymers known in this art that are suitable for this purpose. When acrylic is used, page support 12 is fashioned by cutting using devices such as a router, saw or laser cam. For high volume manufacturing processes, the more economical method of manufacturing would be stamping polycarbonate sheets from a mold. Alternatively, page support 12 may be manufactured using dissimilar materials for the base plate and the lateral wing folds. The lateral wing folds may be transparent and attachable to a base plate that may, but need not be, transparent. An example of a dissimilar material for the base plate would be a substance such as a ceramic material.

Both interlocking endcap 44 and interlocking endcap 58 may be constructed using materials such as metals and metal alloys, as well as, natural or synthetic polymers and copolymers. Either endcap may be fashioned using an automatic lathe or by injection molding. Injection molding is particularly feasible when using thermoplastics.

Preferably, the two halves of interlocking endcap 44 and interlocking endcap 58 are made separately. Before the two halves of interlocking endcap 58 are assembled, the looped end of elastic cord 68 is secured onto internal fixture 71. The free end of elastic cord 68 is slipped through a slot in clip 36 and fastened to itself by staples, crimping, thread (not depicted), or other suitable means for affixing clip 36 permanently to elastic cord 68. Clip 36 may comprise any material, such as metal or polymer, that resists deformation or fracturing when the piece is under tension from elastic cord 68.

Rigid rod 42, which suspends the reading material, ideally has a uniform cross section, possesses a small diameter, and is extremely stiff. As with the other pieces of the present invention, particularly the endcaps, any number of metals, metal alloys, and natural and synthetic polymers and copolymers are useful in this capacity. The list of useful materials is exhaustive and includes, but is not limited to, steel, iron, nickel, chrome, and their alloys, various natural and synthetic rubbers, poly-vinyl-chloride, polystyrene, polyethylene, polypropylene, polycarbonate, acrylic, methacrylic, and their copolymers, thermoset resins and epoxies, and thermoplastic resins are suitable for use.

Additionally, all materials are preferably chosen for their suitability for cleaning and even for sterilization in an autoclave, and generally should meet any requirements for use in a medical facility setting.

In a preferred embodiment of reading assistive device 10, two holes 28, 30 are cut through the surface of page securing subassembly 12. Holes 28, 30 permit the screw attachment of an articulated swing arm subassembly 38 (depicted in phantom in FIG. 1). Other mounting apparatuses are available, such as, Greenfield arms, and the present invention is not limited to any one style. Additionally, the present invention anticipates using a retractable mechanism for attachment that is adaptable for mounting to either a bed frame or bed railing.

In operation, when reading assistive device 10 is used, as shown in FIG. 1, the binding of the journal, magazine, book, or similar source, is placed along rigid rod 42, which suspends the reading material. To secure thicker journals from slipping off rigid rod 42, elastic cord 68, when taut, provides a downward force on the binding. The tension is achieved on elastic cord 68 when a clip 36, located at the end of elastic cord 68, is secured to clip securing groove 52 that runs perpendicularly to the longitudinal clip groove 46 (depicted in FIG. 6*b*). When clip 36 is secure, part of elastic cord 68 lies in elastic cord groove 60 that runs along the surface longitudinally to interlocking endcap 58. Both interlocking endcap 44 and interlocking endcap 58 are made of a lightweight, rigid material that will not deform when under tension.

As depicted in FIG. 1, the vice mount on an articulated swing arm subassembly 38 first clamps onto a bed rail. After being properly secured, the articulated swing arm subassembly 38 is attached to page support 12. Clip 36 is unlatched from interlocking endcap 44. The reading material is placed through central window 18 so that the binding of the reading material rests parallel on rigid rod 42 of securing subassembly 40. The reading material will preferentially be hung so that the pages of the reading material rest on left wing fold 20 and right wing fold 22, with half of the pages falling on each wing. The reading material is secured by inserting the bent edge of clip 36 into clip securing groove 52 located on interlocking endcap 44.

The orientation and angle of reading assistive device 10 is adjusted. For more severely injured or debilitated patients, assistive device 10 is adjusted so that the user's mouthstick can easily interact with the pages of the magazine resting on left wing fold 20 and right wing fold 22. More specifically, the mouthstick should be able to reach through slots 24, 26. Once the orientation of a reading assistive device 10 is established, the articulations on the articulated swing arm subassembly are tightened for minimal movement. Afterwards, all the pages of the reading material are turned and secured to the opposite side of page support 12.

After the reading material and reading assistive device 10 are properly prepared, the user may interact with the reading material using a rubber-tipped item such as a mouthstick or wand. After the individual finishes reading a page, the user slips the mouthstick through slots 24, 26 located on either wing fold 20, 22 of interest. Pressure from the mouthstick is applied to the page, and the friction between the mouthstick and page causes a page to move out of either wing fold 20, 22. The dangling page is then turned to the opposite wing fold 20, 22 and the mouthstick is moved to the edge of the turning page as the paper moves near the opposite wing fold 20, 22 and slots 24, 26. The journal page slips behind the opposite wing fold 20, 22 as the mouthstick moves towards the base of corresponding slot 24, 26. As the mouthstick moves longitudinally along slot 24, 26, the edge of the page moves towards the base of wing fold 20, 22, where it can rest securely in page support 12.

The foregoing description is considered as illustrative only of the principles of the invention, since numerous modifications and changes will readily occur to those skilled in the art. Consequently, it is not desirable to limit the invention to the exact construction and operation shown and described herein. Accordingly, all suitable modification and equivalents may be resorted to, falling within the scope of the present invention.

I claim:

1. A reading assistive device for use by a person in a recumbent or reclined position to suspend a reading material above the person in a readable position, the device comprising:

a page support having a base plate with an upper surface, a lower surface adapted to face the person, a front edge, a back edge, a central window, and lateral wing folds that bend back toward the lower surface of the base plate, each wing fold having a slot oriented in a direction parallel to the front and back edges and forming a plane surface that is tilted toward the lower surface and forms an acute angle with the plane of the lower surface medially; and a securing subassembly comprising a first endcap, a second endcap and a rigid rod connecting the first and second endcaps, the first and second endcaps being operably coupled to the base plate toward respective front edge and back edge, bisecting the base plate at the base plate midpoint with the rigid rod oriented perpendicular to the front and back edges, the first endcap having an elastic cord affixed thereto, the elastic cord having a clip at a free end of the elastic cord, the clip being operably and releasably attachable to the second endcap;

so that the reading material may be draped over the rigid rod through the central window with the elastic cord securing the reading material to the rigid rod by clipping the clip to the second endcap and then placing opposing pages of the reading material in the spaces between the respective wing folds and the lower surface of the base plate, exposing the reading pages, in sequence, through the slots of the respective wing folds.

2. The device of claim 1 further comprising mounting means for securely mounting the device to a bed.

3. The device of claim 2 in which the mounting means comprises an articulated arm attached to the base plate on the base plate upper surface and adapted to mount the other end of the articulated arm to either a frame of the bed or a railing of the bed.

4. The device of claim 1 in which the page support comprises a transparent synthetic polymer.

5. The device of claim 4 in which the synthetic polymer is chosen from a list of synthetic polymers consisting of: acrylates, methacrylates, copolymers of acrylates and methacrylates, epoxy resin, poly-vinyl-chloride, polypropylene, polycarbonate, polyethylene, and polystyrene.

6. The device of claim 1 in which the base plate and wing folds comprise dissimilar materials.

7. The device of claim 6 in which the base plate comprises a metallic material and the wing folds comprise a transparent synthetic material.

8. The device of claim 6 in which the base plate comprises a ceramic material and the wing folds comprise a transparent synthetic material.

9. The device of claim 1 in which the first and second endcaps are comprised of polymeric materials.

10. The device of claim 9 in which the polymeric material is chosen from a list of synthetic polymers consisting of: acrylates, methacrylates, copolymers of acrylates and methacrylates, epoxy resin, poly-vinyl-chloride, polypropylene, polycarbonate, polyethylene, and polystyrene.

11. The device of claim 1 in which the rigid rod comprises a metal or metal alloy.

12. The device of claim 1 in which the rigid rod comprises a polymeric material.

13. The device of claim 12 in which the polymeric material is chosen from a list of synthetic polymers consisting of: acrylates, methacrylates, copolymers of acrylates and methacrylates, epoxy resin, poly-vinyl-chloride, polypropylene, polycarbonate, polyethylene, and polystyrene.

* * * * *